US005423275A

United States Patent [19]

Kanjo

[11] Patent Number: 5,423,275

[45] Date of Patent: Jun. 13, 1995

[54] COMBINATION WEAR AND LUBRICATING LINER ASSEMBLY FOR RAILWAY CAR TRUCK BOLSTER BOWL

[75] Inventor: Wajih Kanjo, Lockport, Ill.

[73] Assignee: Westinghouse Air Brake Company, Wilmerding, Pa.

[21] Appl. No.: 154,189

[22] Filed: Nov. 18, 1993

[51] Int. Cl.[6] ..... B61F 5/00

[52] U.S. Cl. ..... 105/199.4

[58] Field of Search ..... 105/199.4; 384/422

[56] References Cited

U.S. PATENT DOCUMENTS

| | | | |
|---|---|---|---|
| 2,600,704 | 6/1952 | Travilla et al. | 105/199.4 |
| 3,549,217 | 12/1970 | Watson | 105/199.4 |
| 4,075,951 | 2/1978 | Chierici et al. | 105/199.4 |
| 4,222,331 | 9/1980 | Gage et al. | 105/199.4 |
| 4,224,876 | 9/1980 | Larsen | 105/199.4 |
| 4,275,661 | 6/1981 | Mowles | 105/199.4 |
| 4,308,801 | 1/1982 | Cooper et al. | 105/199.4 |
| 4,398,330 | 8/1983 | Meadows | 105/199.4 |
| 4,593,829 | 6/1986 | Altherr | 213/75 R |
| 4,867,071 | 9/1989 | Weber | 105/4.1 |
| 5,228,393 | 7/1993 | Woolston | 105/199.4 |

FOREIGN PATENT DOCUMENTS

| | | | |
|---|---|---|---|
| 0522616 | 11/1955 | Belgium | 105/199.4 |
| 8001784 | 9/1980 | WIPO | 105/199.4 |

OTHER PUBLICATIONS

Pp. 338, 339, 772 and 775 of Car and Locomotive Cyclopedia, 1970.

*Primary Examiner*—Mark T. Le

*Attorney, Agent, or Firm*—James O. Ray, Jr.

[57] ABSTRACT

A wear and lubricating liner having a cup-shaped wear liner assembly which includes a first bottom plate portion. An aperture is formed centrally through such first bottom plate and a first upstanding wall portion is connected at a bottom thereof to an outer perimeter of such first bottom plate. A lubricating liner assembly having at least one substantially solid lubricating material with a bottom surface thereof disposed adjacent and in contact with an upper surface of such bottom plate and a vertically disposed ring-like solid lubricating material. An outer surface of such ring-like lubricating material is disposed adjacent and in contact with an inner surface of such upstanding wall of the wear liner. A protective cover member includes a second bottom plate portion having a bottom surface disposed adjacent and in contact with an upper surface of such at least one solid lubricating material. Another aperture is formed centrally through such second bottom plate. A second upstanding wall portion, located on the protective cover, is connected at a bottom thereof to an outer perimeter of such second bottom plate and an annular lip-like portion is connected adjacent an inner edge thereof to an upper edge of such second upstanding wall. Such lip-like portion extends outwardly from such upper edge of the second upstanding wall and downwardly toward a top surface of such bolster bowl. A space is disposed between an inner surface of such ring-like lubricating material and an outer surface of such second upstanding wall.

19 Claims, 3 Drawing Sheets

COMBINATION WEAR AND LUBRICATING LINER ASSEMBLY FOR RAILWAY CAR TRUCK BOLSTER BOWL

FIELD OF THE INVENTION

The present invention relates, in general, to wear liner components and lubrication of railway car truck bolster center bowls and, more particularly, this invention relates to an improved combination wear and lubricating liner assembly for use in such truck bolster center bowls.

BACKGROUND OF THE INVENTION

It is very well recognized, by both maintenance and design engineers in the railway industry, that in order to negotiate the curves encountered in a track structure, during train operation, a rotatable connection must be provided between the railway car body portion and the railway truck portion. This connection is usually accomplished, in a standard railway car, by use of a center plate member secured to the bottom of such car along the longitudinal centerline thereof and the bolster bowl disposed on the top of such railway truck. In an articulated coupling arrangement, however, used to connect adjacent ends of a pair of railway cars together in a substantially semipermanent manner, this rotatable connection is accomplished between the female connection member and the bolster bowl.

Lubrication of such rotatable connection is generally quite difficult to achieve and it is, also, even more difficult to maintain sufficient lubricant in place due to the very hostile environment encountered. For example, during operation of a train consist in a rain storm, moisture may cause the lubricant being used to be washed out of such bolster bowl prematurely. Lack of lubrication in this critical area can cause undue frictional wear on the car components, thus adding to the repair and maintenance cost. Additionally, and of even more concern to the railroad industry, such lack of lubrication, in the most severe cases, may even lead to derailments occurring. Obviously, this may lead to injury or damage to lading being carried by the railroad thereby adding significantly to their cost of doing business.

SUMMARY OF THE INVENTION

The present invention provides an improved combination wear and lubricating liner assembly for reducing wear on the bolster bowl disposed on an upper surface of a railway car truck. Such combination wear and lubricating liner assembly will include a generally round cup-shaped wear liner assembly having a first predetermined outer diameter and a first predetermined inner diameter. The wear liner assembly will include a first generally round bottom plate portion having a first predetermined thickness. A first centrally disposed aperture, having a first predetermined diameter, is formed through such first bottom plate portion. The wear liner assembly will also include a first upstanding generally round wall portion, having such first predetermined thickness and a first predetermined height, connected at a bottom portion thereof to an outer perimeter of the first bottom plate portion. Such combination wear and lubricating liner assembly will further include a lubricating liner assembly. Such lubricating liner assembly includes at least one substantially solid lubricating material having a bottom surface disposed adjacent and in contact with an upper surface of such bottom plate portion of said wear liner assembly and a vertically disposed ring-like substantially solid lubricating material, having a second predetermined height. An outer surface of such ring-like lubricating material is disposed adjacent and in contact with an inner surface of such upstanding wall portion of the wear liner assembly. The wear and lubricating liner assembly further includes a protective cover member having a second predetermined outer diameter and a second predetermined inner diameter. Such protective cover member includes a second generally round bottom plate portion, having a second predetermined thickness. A bottom surface of such second bottom plate portion is disposed adjacent and in contact with an upper surface of such at least one substantially solid lubricating material. The protective cover member has a second centrally disposed aperture, having a second diameter, formed through such second bottom plate portion. A second upstanding generally round wall portion, having such second predetermined thickness and a third predetermined height, is connected at a bottom portion thereof to an outer perimeter of the second bottom plate portion, and an annular lip-like portion is connected adjacent an inner edge thereof to an upper edge of such second upstanding wall portion. This lip-like portion extends outwardly from such upper edge of the second upstanding wall portion and downwardly toward a top surface of such bolster bowl. Finally, an annular space is disposed between an inner surface of such ring-like lubricating material and an outer surface of such second upstanding wall portion. A width of such annular space being predetermined.

OBJECTS OF THE INVENTION

It is, therefore, one of the prior objects of the present invention to provide a combination wear and lubricating liner assembly which will reduce the required frequency of lubrication in the center bowl of a railway car truck.

Another object of the present invention is to provide an improved combination wear and lubricating liner assembly which is relatively simple to install.

Still another object of the present invention is to provide an improved combination wear and lubricating liner assembly which can be used regardless of the coupling system used to connect adjacent ends of a pair of railway cars together.

Yet another object of the present invention is to provide an improved combination wear and lubricating liner assembly in which the lubricating liner is protected against moisture and/or debris coming into contact therewith.

A further object of the present invention is to provide an improved combination wear and lubricating liner assembly in which a polymer type solid lubricant can be effectively used.

An additional object of the present invention is to provide an improved combination wear and lubricating liner assembly which has the potential to reduce derailments due to the car body center plate sticking to the center bowl disposed on the truck bolster bowl.

Still yet another object of the present invention is to provide an improved combination wear and lubricating liner assembly which can be readily produced in a variety of sizes.

Yet still another object of the present invention is to provide an improved combination wear and lubricating liner assembly in which the wear liner assembly and the protective cover member can be manufactured as a single piece stamping thereby providing savings in manufacturing cost.

A still further object of the present invention is to provide an improved combination wear and lubricating liner assembly which can be easily retrofitted to existing railway car trucks disposed beneath the car body or an articulated coupling arrangement.

In addition to the various objects and advantages of the improved combination wear and lubricating liner assembly described above, various additional objects and advantages of the present invention will become more readily apparent to those persons who are skilled in the railway car maintenance art from the following more detailed description of the invention, particularly, when such description is taken in conjunction with the attached drawing Figures and with the appended claims.

DESCRIPTION OF THE PREFERRED EMBODIMENTS OF THE INVENTION

Figure 1:
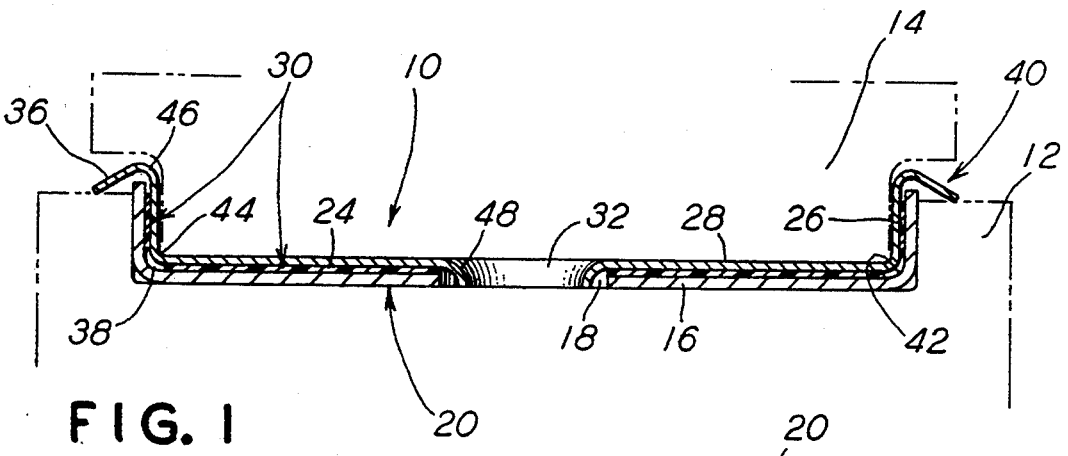
FIG. 1 is a side elevational view, partially in cross section, of a presently preferred embodiment of the instant invention.

Prior to proceeding to the more detailed description of the present invention, it should be noted that, for the sake of clarity, identical components having identical functions, have been identified with identical reference numerals throughout the several views illustrated in the drawing Figures.

Now refer more particularly to FIGS. 1 through 5 of the drawings. Illustrated therein is one presently preferred embodiment of an improved combination wear and lubricating liner assembly, generally designated, 10 for use in providing a requisite amount of lubrication in a bolster bowl 12 disposed on an upper surface of a railway car truck (not shown).

Figure 2:
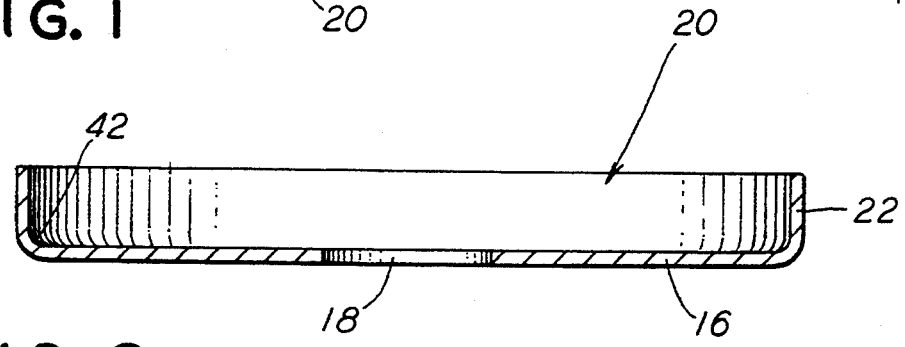
FIG. 2 is a cross sectional view of a presently preferred wear liner assembly illustrated in FIG. 1.
Figure 3:
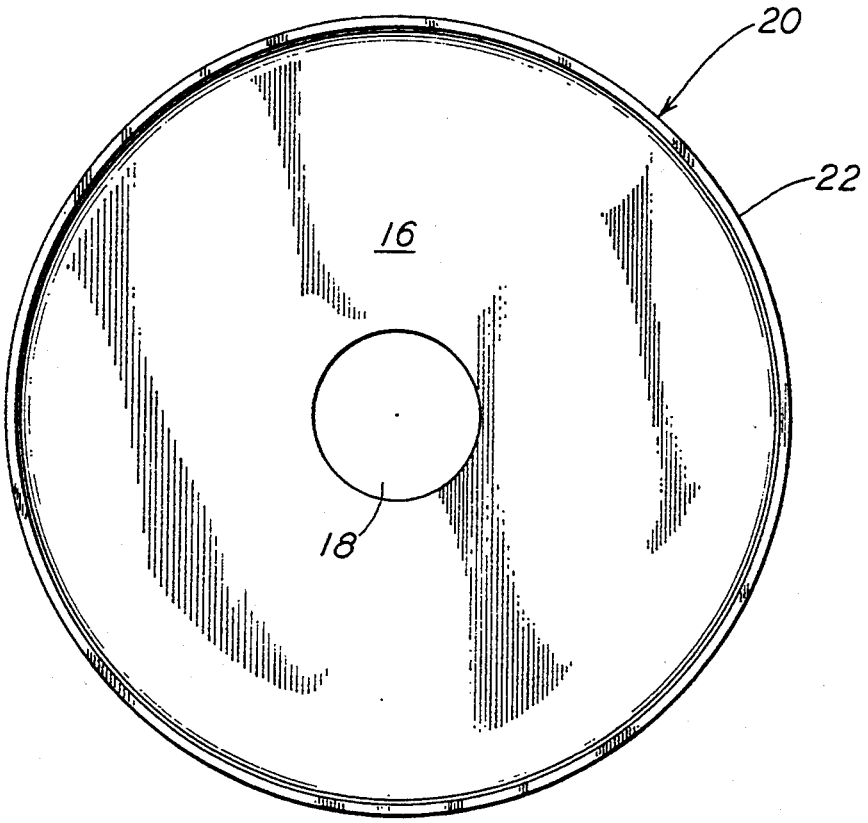
FIG. 3 is a top plan view of the presently preferred wear liner assembly illustrated in FIGS. 1 and 2.

As best seen in FIG. 2, such combination wear and lubricating liner 10 includes a generally round cup-shaped wear liner assembly,generally designated, 20 having a first predetermined outer diameter and a first predetermined inner diameter. Such predetermined diameters being predicated on the inner diameter of such bolster bowl 12 and the outer diameter of the center plate portion (not shown) of a railway car or an articulated coupling center plate portion 14 which rides in the bolster bowl 12.

The wear liner assembly 20 includes a first generally round bottom plate portion 16 having a first predetermined thickness. Formed through such first bottom plate portion 16 is a first centrally disposed aperture 18 having a first predetermined diameter. There is a first upstanding generally round wall portion 22 connected at a bottom portion thereof to an outer perimeter of such first bottom plate portion 16. The first upstanding wall portion 22 has a first predetermined height and is generally the same thickness as the first bottom plate portion 16. Preferably, the height of such first upstanding wall portion 22 will be greater than the depth of such bolster bowl 12 to direct excess moisture to an area disposed between an outer surface of such wear liner assembly 20 and the inner surface of the bolster bowl 12.

Preferably, the first predetermined height of such first upstanding wall portion 22 is at least sufficient to enable an upper edge of such first upstanding wall portion 22 to extend above the upper surface of such bolster bowl 12. This enables any excess moisture and/or debris on this surface to be drained between the outer surface of the wear liner assembly 10 and the inner surface of bolster bowl 12. In addition, it is preferred that such first bottom plate portion 16 and the first upstanding wall portion 22 are formed as a single piece wear liner 20, such as, by stamping.

Another essential element of the combination wear and lubricating liner assembly 10 is a lubricating liner assembly, generally designated, 30.

Such lubricating liner assembly 30 includes at least one substantially flat solid lubricating material 24. A bottom surface of such solid lubricating material 24 is disposed adjacent and in contact with an upper surface of the bottom plate portion 16 of the wear liner assembly 20. Lubricating liner assembly 30 also includes a vertically disposed ring-like substantially solid lubricating material 26 having a second predetermined height. Preferably, the second predetermined height of such ring-like lubricating material 26 will be less than the first predetermined height of such first wall portion 22 of the wear liner assembly 20. An outer surface of such ring-like lubricating material 26 is disposed adjacent and in contact with an inner surface of the first upstanding wall portion 22 of the wear liner assembly 20.

Preferably, such solid lubricating material is a polymer type lubricant. When the lubricating liner assembly 30 has a single flat piece solid lubricating material 24, there will be a third centrally disposed aperture formed therethrough. Such third centrally disposed aperture having essentially the same diameter as such first predetermined diameter formed through the first bottom plate 16. Alternatively, a plurality of flat solid lubricating material pieces may be used between the first bottom plate 16 and the second bottom plate 24. This provides the advantage that should the lubricating liner material be deformed it can flow into the spaces between the plurality of pieces.

Figure 4:
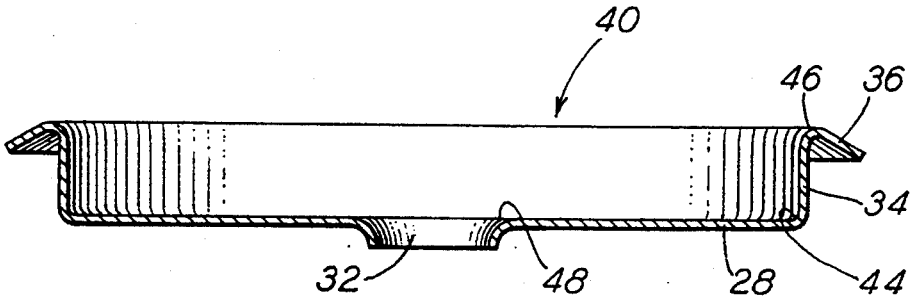
FIG. 4 is a cross sectional view of the presently preferred protective cover member illustrated in FIG. 1.
Figure 5:
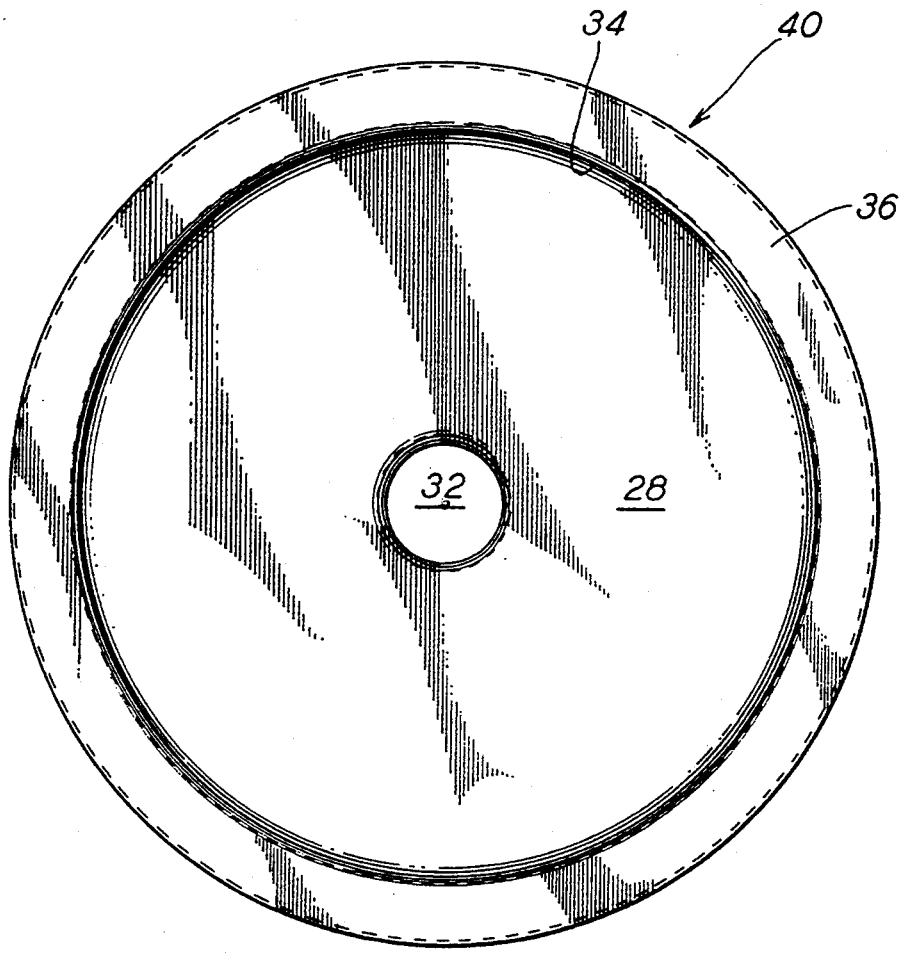
FIG. 5 is a top plan view of the presently preferred protective cover member illustrated in FIGS. 1 and 4.
Figure 6:
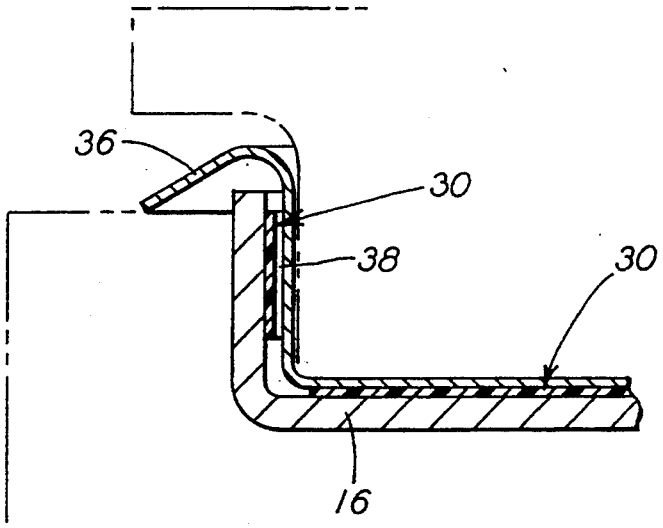
FIG. 6 is an enlarged partial view, in cross section, which illustrates a presently preferred annular space disposed intermediate the inner surface of the upstanding portion of the lubricating liner assembly and the outer surface of the upstanding wall portion of the protective cover member.

As best seen in FIG. 4, the combination wear and lubricating liner assembly 10 further includes a protective cover member, generally designated, 40.

Such protective cover member 40 has a second predetermined outer diameter and a second predetermined inner diameter. Such protective cover member 40 includes a second generally round plate portion 28 having a second predetermined thickness. A bottom surface of such second bottom plate portion 28 is disposed adjacent and, preferably, in slidable contact with an upper surface of such at least one substantially flat solid lubricating material 24. A second centrally disposed aperture 32, having a second predetermined diameter, is formed through the second bottom plate portion 28 of the protective cover member 40. Connected at a bottom portion thereof to an outer perimeter of the second bottom plate portion 28 is a second upstanding and generally round wall portion 34. Such second wall portion 34 has a second predetermined thickness and a third predetermined height. The final essential element of such protective cover member 40 is an annular lip-like portion 36 which is connected adjacent an inner edge thereof to an upper edge of the second upstanding wall portion 34. Such annular lip-like portion 36 extends outwardly from the upper edge of such second upstanding wall portion 34 and downwardly towards a top surface of such bolster bowl 12. Preferably, the outer edge of the lip-like portion 36 will be in contact with such top surface of the bolster bowl 12. Preferably, the protective cover member 40 further includes a lip-like portion 48 which extends downwardly from the second bottom plate 28 adjacent the second aperture 32 formed in bottom plate 28 for a predetermined distance. Such predetermined distance is, preferably, at least about 0.25 inches.

In the presently preferred embodiment of the invention, such bottom plate portion 28, the second upstanding wall portion 34 and such annular lip-like portion 36 are formed as a single piece protective cover member 40, such as, by stamping. Additionally, the third predetermined height of such second upstanding wall portion 34 of the protective cover member 40 will be greater than the first predetermined height of such first upstanding wall portion 22 of the wear liner assembly 20.

Finally, the combination wear and lubricating liner assembly 10 includes an annular space 38 disposed between an inner surface of such ring-like lubricating material 26 and the outer surface of such second upstanding wall portion 34 of protective cover member 40. The width of such annular space being predetermined. Such annular space disposed between the inner surface of such ring-like lubricating material 26 and the outer surface of such second upstanding wall portion 34 of the protective cover member 40 will be substantially between about 0.025 inches and about 0.095 inches.

According to the presently preferred embodiment of the invention, the combination wear and lubricating liner assembly 10 further includes a radius portion 42 disposed between the outer perimeter of the first bottom plate portion 16 and the bottom edge portion of such first upstanding wall portion 22. Such radius portion 42 has a first predetermined radius which is, preferably, between about 0.03 inches and about 0.325 inches. Additionally, in this embodiment, another radius portion 44 is disposed between the outer perimeter of the second bottom plate portion 28 and a bottom edge portion of the second upstanding wall portion 34 of protective cover member 40. Radius portion 44 has a second predetermined radius which, preferably, is larger than the radius portion 42. Combination wear and lubricating liner assembly 10 has another radius portion 46 disposed between the upper edge of the second upstanding wall portion 34 and an inner edge of the annular lip-like portion 36 of protective cover member 40. Radius portion 46 has a third predetermined radius which, preferably, is between about 0.15 inches and about 0.20 inches.

It is presently preferred that the first predetermined diameter of such first aperture 18 formed through the first bottom plate 16 will be greater than the second predetermined diameter of such second aperture 32 formed through the second bottom plate 28 and that the first predetermined thickness of such wear liner assembly 20 will be greater than the second predetermined thickness of such protective cover member 40. It is, generally, preferred that such first predetermined thickness is substantially between about 0.15 inches and about 0.125 inches with such second predetermined thickness being substantially between about 0.07 inches and about 0.08 inches.

While a number of presently preferred embodiments of the improved combination wear and lubricating liner have been described in detail above, it should be understood that various other adaptations and modifications to the invention can be made by those persons who are skilled in the railway art without departing from the spirit and scope of the appended claims.

We claim:

1. An improved combination wear and lubricating liner assembly for a bolster bowl disposed on an upper surface of a railway car truck, said combination wear and lubricating liner assembly comprising:

(a) a generally round cup-shaped wear liner assembly having a first predetermined outer diameter and a first predetermined inner diameter, said wear liner assembly including,
  (i) a first generally round bottom plate portion having a first predetermined thickness,
  (ii) a first centrally disposed aperture, having a first predetermined diameter, formed through said first bottom plate portion, and
  (iii) a first upstanding generally round wall portion, having said first predetermined thickness and a first predetermined height, connected at a bottom portion thereof to an outer perimeter of said first bottom plate portion;

(b) a lubricating liner assembly, said lubricating liner assembly including,
  (i) at least one substantially flat solid lubricating material having a bottom surface disposed adjacent and in contact with an upper surface of said bottom plate portion of said wear liner assembly, and
  (ii) a vertically disposed ring-like substantially solid lubricating material, having a second predetermined height, an outer surface of said ring-like lubricating material disposed adjacent and in contact with an inner surface of said upstanding wall portion of said wear liner assembly;

(c) a protective cover member having a second predetermined outer diameter and a second predetermined inner diameter, said protective cover member including,
  (i) a second generally round bottom plate portion, having a second predetermined thickness, a bottom surface of said second bottom plate portion being disposed adjacent and in contact with an upper surface of said at least one substantially solid lubricating material,
  (ii) a second centrally disposed aperture, having a second predetermined diameter, formed through said second bottom plate portion,
  (iii) a second upstanding generally round wall portion, having said second predetermined thickness and a third predetermined height, connected at a bottom portion thereof to an outer perimeter of said second bottom plate portion, and
  (iv) an annular lip-like portion connected adjacent an inner edge thereof to an upper edge of said second upstanding wall portion, said lip-like portion extending outwardly from said upper edge of said second upstanding wall portion and downwardly toward a top surface of such bolster bowl; and (d) an annular space disposed between an inner surface of said ring-like lubricating material and an outer surface of said second upstanding wall portion, a width of said annular space being predetermined.

2. An improved combination wear and lubricating liner assembly, according to claim 1, wherein said combination wear and lubricating liner assembly further includes a radius portion, having a first predetermined radius, disposed between said outer perimeter of said first bottom plate portion and said bottom portion of said first upstanding wall portion.

3. An improved combination wear and lubricating liner assembly, according to claim 1, wherein said combination wear and lubricating liner assembly further includes a radius portion, having a second predetermined radius, disposed between said outer perimeter of said second bottom plate portion and said bottom portion of said second upstanding wall portion.

4. An improved combination wear and lubricating liner assembly, according to claim 3, wherein said combination wear and lubricating liner assembly further includes a radius portion, having a third predetermined radius, disposed between said upper edge of said second upstanding wall portion and said inner edge of said annular lip-like portion.

5. An improved combination wear and lubricating liner assembly, according to claim 1, wherein said first predetermined diameter of said first aperture formed through said first bottom plate is greater than said second predetermined diameter formed through said second bottom plate.

6. An improved combination wear and lubricating liner assembly, according to claim 5, wherein said protective cover member further includes a lip-like portion extending downwardly from said second bottom plate adjacent said second aperture for a predetermined distance.

7. An improved combination wear and lubricating liner assembly, according to claim 6, wherein said predetermined distance is at least about 0.25 inches.

8. An improved combination wear and lubricating liner assembly, according to claim 1, wherein said first predetermined thickness of said wear liner assembly is greater than said second predetermined thickness of said protective cover member.

9. An improved combination wear and lubricating liner assembly, according to claim 1, wherein said lubricating liner assembly has a single piece solid lubricating material and a third centrally disposed aperture, having said first predetermined diameter formed through said single piece solid lubricating material.

10. An improved combination wear and lubricating liner assembly, according to claim 1, wherein said first bottom plate portion and said first upstanding wall portion are formed as a single piece wear liner.

11. An improved combination wear and lubricating liner assembly, according to claim 10, wherein said second bottom plate portion, said second upstanding wall portion and said annular lip-like portion are formed as a single piece protective cover member.

12. An improved combination wear and lubricating liner assembly, according to claim 1, wherein said first predetermined height of said first upstanding wall portion is at least sufficient to enable an upper edge of said upstanding wall portion to extend above such top surface of such bolster bowl.

13. An improved combination wear and lubricating liner assembly, according to claim 12, wherein an outer edge of said annular lip-like portion contacts such top surface of such bolster bowl.

14. An improved combination wear and lubricating liner assembly, according to claim 1, wherein said annular space disposed between said inner surface of said ring-like lubricating material and said outer surface of said second upstanding wall portion is substantially between about 0.025 inches and about 0.095 inches.

15. An improved combination wear and lubricating liner assembly, according to claim 1, wherein said first predetermined thickness is substantially between about 0.15 inches and about 0.125 inches.

16. An improved combination wear and lubricating liner assembly, according to claim 15, wherein said second predetermined thickness is substantially between about 0.07 inches and about 0.08 inches.

17. An improved combination wear and lubricating liner assembly, according to claim 1, wherein said solid lubricating material is a lubricating polymer.

18. An improved combination wear and lubricating liner assembly, according to claim 1, wherein said first predetermined height of said first upstanding wall portion is less than said third predetermined height of said second upstanding wall portion.

19. An improved combination wear and lubricating liner assembly, according to claim 18, wherein said first predetermined height of said first upstanding wall portion is greater than said second predetermined height of said ring-like lubricating material.

* * * * *